US005245932A

United States Patent [19]

Ujiie

[11] Patent Number: 5,245,932

[45] Date of Patent: Sep. 21, 1993

[54] HEAT-SENSITIVE STENCIL MASTER SHEET

[75] Inventor: Mitsuru Ujiie, Tokyo, Japan

[73] Assignee: Riso Kagaku Corporation, Tokyo, Japan

[21] Appl. No.: 824,151

[22] Filed: Jan. 22, 1992

[30] Foreign Application Priority Data

Jan. 23, 1991 [JP] Japan ..... 3-06509
Jan. 23, 1991 [JP] Japan ..... 3-06510

[51] Int. Cl.[5] ..... B41C 1/055

[52] U.S. Cl. ..... 101/128.11; 101/128.21; 101/129; 156/253

[58] Field of Search ..... 101/128.21, 128.4, 127, 101/129; 156/253, 252

[56] References Cited

U.S. PATENT DOCUMENTS 1,997,594 4/1935 Mabley ..... 101/128.21
4,096,308 6/1978 Reed ..... 101/128.21
4,958,560 9/1990 Collins ..... 101/128.21

FOREIGN PATENT DOCUMENTS 16793 1/1984 Japan ..... 101/128.21
33196 2/1984 Japan ..... 101/128.21
33197 2/1984 Japan ..... 101/128.21
5891 1/1987 Japan ..... 101/128.21

*Primary Examiner*—Edgar S. Burr
*Assistant Examiner*—Lynn D. Hendrickson
*Attorney, Agent, or Firm*—Fay, Sharpe, Beall, Fagan, Minnich & McKee

[57] ABSTRACT

A heat-sensitive stencil master sheet having good perforation properties, having prevented reduction in the resolution and setting-off of ink to the surface of printed matters and affording a good printed image is provided, which sheet is prepared by laminating a thermoplastic resin film on a permeable sheet of fibers wherein the sum of the clearance areas surrounded by fibers of the sheet same as or less than the area sought by a product of the primary scanning pitch of the thermal head of a heat-sensitive stencil printing device to be used, by the secondary scanning pitch thereof in the advancing direction of the sheet occupies 80% or more of the total of the clearance areas of the sheet.

15 Claims, 2 Drawing Sheets

HEAT-SENSITIVE STENCIL MASTER SHEET

BACKGROUND OF THE INVENTION

1. Field of the Invention

This invention relates to a heat-sensitive stencil master sheet. Particularly it relates to a heat-sensitive stencil master sheet having superior perforating and printing characteristics, and a process for digital-perforating the heat-sensitive stencil master sheet using a digital stencil-making device having a thermal head.

2. Description of the Related Art

The stencil master sheet so far used for stencil master printing has generally been prepared by adhering a thermoplastic resin film (hereinafter often abbreviated to film) onto a permeable substrate with an adhesive. In recent years, as such a stencil master sheet, a heat-sensitive sheet for digital perforation by the heat of a thermal head is prevailing, and in order to obtain printed matters having good resolving properties, a heat-sensitive stencil-making and printing device having a thermal head having a high resolution is used. As conditions of the permeable substrate used for the heat-sensitive stencil master sheet, easy handling, no occurrence of wrinkles in the sheet at the time of perforation, durability to printing, etc. are required. Since the quantity of ink passed through the perforated master sheet for the printed image and its quantity retained in the master sheet vary depending upon the kind of the substrate, various regulations of the master sheet such as basis weight, thickness, density, dispersibility of ink, strength (or wet strength), stiffness, etc. have been provided.

However, the heat-sensitive stencil master sheet used in the prior-art has been chosen based mainly upon the quantity of ink passed and the quantity of ink retained relative to the image properties, but no sufficient consideration has been paid to the effect upon the perforation of film, and there may occur a case of insufficient perforation or a case of connected perforations, where it is difficult to control the quantity of ink passed.

Printed matters printed by a perforated stencil master sheet having insufficient perforations or non-perforated parts have drawbacks in that they are inferior in the resolving properties and the reproduction of fine letters, to cause parts where no ink is attached, such as white points at a solid part or parts reduced in ink concentration. Further, printed matters printed by a perforated stencil master sheet having connected or broadened perforations have drawbacks in that the quantity of ink transferred increases extremely, and reduction in the resolving properties or increase in the setting-off of ink to the surface of the printed matter due to exudation of ink occur.

SUMMARY OF THE INVENTION

An object of the present invention is to provide a heat-sensitive stencil master sheet that solves the above-mentioned problems of the prior art by having good perforation properties, and by preventing reduction in the resolution or setting-off of ink to the printed matters due to ink exudation, to give a good printed image. A further object is to provide a process for digital-perforation of the above stencil master sheet.

DETAILED DESCRIPTION OF THE DRAWINGS

Figure 1:
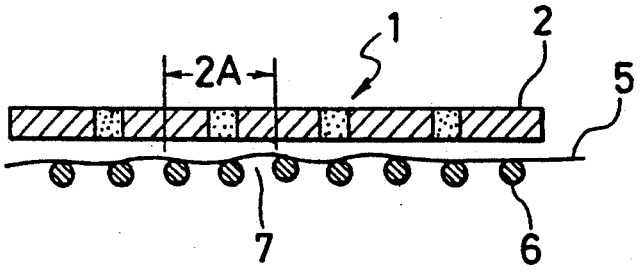
FIG. 1 shows a typical view illustrating the relationship between a heat-sensitive stencil master sheet and a thermal head of a digital stencil-making device according to the present invention.

A thermal head used in a stencil-making device includes heating elements 2 of Al, for example, aligned on a resistance layer at right angles to the advancing direction of the sheet 3 (FIG. 3), and a composite ceramic layer supporting the resistance layer. The heat elements 2 may be aligned in a plurality of rows. A dot pitch, which is referred to as a primary scanning pitch, is defined as a distance 2A between the centers of the adjacent heating elements 2 in the same row as shown in FIG. 1.

Usually, the thermal head used for the digital stencil-making device has a dot pitch as fine as 400 dpi (dots per inch), whereas, a number of clearance areas surrounded by the fibers of the stencil master sheet have an area exceeding that of the above dot pitch, so that no substrate supporting the film is often present in the clearance areas.

Figure 5:
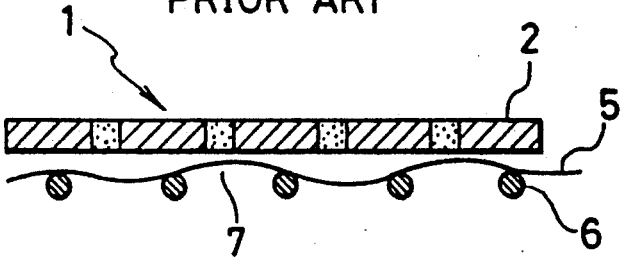
FIG.5 PRIOR ART
FIG. 5 shows a view illustrating the relationship between a conventional heat-sensitive stencil master sheet and a thermal head of a digital stencil-making device.

FIG. 5 shows a view illustrating the relationship between a conventional heat-sensitive stencil master sheet and a heat element of a thermal head. In FIG. 5, since the clearance area 7 surrounded by the substrate fibers 6 of the stencil master sheet is often broader than the clearance area of dot pitch 2A, the contact of the film 5 to the heating element 2 of the thermal head is inferior, so that non-perforation or insufficient perforation may often occur. Further, the dots of the resulting perforations are easy to broaden, since the substrate fibers to support the perforated film are absent. Thus, the perforated dots might often be broadened to adjacent dots to form connected perforations.

The present invention resides in a heat-sensitive stencil master sheet having a thermoplastic resin film adhered onto a permeable substrate used in a digital stencil-making device, the above permeable substrate comprising a sheet of fibers, wherein the sum of the threshold clearance areas, or zones, surrounded by the fibers that are equal to or less than the area determined by the product of the primary scanning pitch, of the thermal head of the heat-sensitive stencil-making device, measured at a right angle to the advancing direction of the sheet, and the secondary scanning pitch thereof measured in the advancing direction of the sheet, occupies 80% or more of the total of the clearance areas surrounded by fibers of the sheet.

The above secondary scanning pitch is defined as a distance between the centers of the adjacent rows of heat elements in the case of using a plurality of rows of heating elements (which distance may also be an advancing pitch of the sheet), or an advancing pitch of the sheet contacting with the thermal head in the case of using a single row of heating elements.

The clearance areas surrounded by fibers in the present invention are measured as follows. When a light is projected onto a heat-sensitive stencil master sheet, holes formed by transmission of the light are observed. By using a printed image-processing system (EXCEL 11, trademark of Japan Avionics Co., Ltd.), ten sites of the sheet to be measured, each $1.5 \times 1.5$ mm$^2$, are taken. Each site is enlarged up to 50 times the original size so that the center of the thickness of the sheet is focused and measured with the respective clearance areas. In this case, areas of 100 $\mu m^2$ or less are neglected as noise. Thus, the proportion of the clearance areas of a predefined area or less, to the total of the clearance areas of the sheet, can be sought by averaging the above measurement values of the ten sites.

Examples of the thermoplastic film used in the present invention are those of polyester, polypropylene, polycarbonate, vinylidene chloride-vinyl chloride copolymer, etc. Its thickness is usually 10 $\mu$m or less, preferably 1 to 6 $\mu$m.

As the permeable substrate, a thin sheet of synthetic fibers such as polyester fibers, polyvinyl alcohol fibers, nylon fibers, etc., natural fibers such as Manila hemp, Kouzo, Mitsumata, pulp, etc. are exemplified. The above fibers may be used alone or in admixture of two or more kinds. The fineness of these fibers is preferably 3 denier or less, and the basis weight of the sheet is preferably 6 to 14 g/m$^2$, more preferably 8 to 13 g/m$^2$. The thickness of the sheet is preferably 10 to 60 $\mu$m, more preferably 15 to 55 $\mu$m.

The thermoplastic film is adhered onto the substrate sheet having the above specific clearance areas to form a heat-sensitive stencil master sheet of the present invention.

FIG. 1 shows a relationship between the heat-sensitive stencil master sheet of the present invention and the heat element provided at the thermal head of a heat-sensitive stencil-making device, when a thermoplastic film of the sheet is contacted with the thermal head. This heat-sensitive stencil master sheet consists of a thermoplastic film 5 and a substrate sheet of fibers 6 supporting the film 5.

Figure 2:
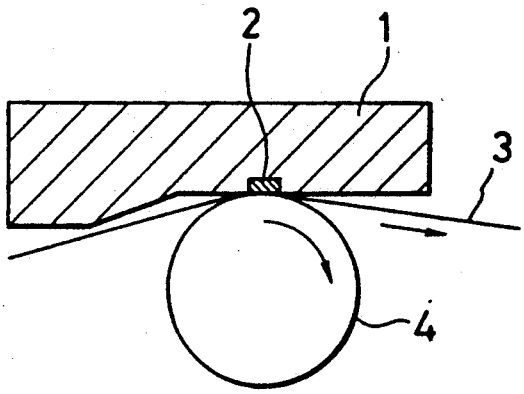
FIG. 2 shows a view of illustrating the perforation mechanism of the stencil master sheet by means of a thermal head of a digital stencil-making device.

FIG. 2 shows an explanatory view of main parts of a heat-sensitive stencil-making device for illustrating the stencil-making mechanism. A heat-sensitive master sheet 3 is fed between a thermal head 1 having many dots of heating elements 2 and a platen-roll 4 by the rotation of the platen-roll 4, and contacts directly the heating elements 2 of the thermal head 1. The sheet 3 is advanced in the direction of the arrow with the rotation of the platen-roll 4 continuously or intermittently, while the thermal head 2 is moved at a right angle to the advancing direction of the sheet 3. At the same time, heat is applied to selective dots of the heating elements 2 of the thermal head so that a selected perforation image is formed on the film of the heat-sensitive stencil master sheet 3.

As the substrate sheet 6, a thin sheet is used wherein the sum of the clearance areas 7, surrounded by fibers, that are equal to or less than the scanning pitch areas of the thermal head occupies 80% or more of the total of the clearance areas of the sheet. The scanning pitch area of the thermal head can be determined by the product of the primary scanning pitch 2A of the thermal head of the stencil-making device, at a right angle to the advancing direction of the sheet, and the secondary scanning pitch thereof in the advancing direction of the sheet. Referring to the figure, since the clearance area 7 is smaller than the scanning pitch area, which is approximated to a dot pitch 2A of the heating element 2 of the thermal head, the film 5 is uniformly attached onto the heating element 2, whereby it is possible to easily obtain independent perforations of the film.

In the case of using a stencil printing device having a thermal head of 400 or more dots per pitch (63.5 $\mu$m or less of dot pitch 2A), a stencil master sheet where the sum of the clearance areas surrounded by fibers being each of 4,000 $\mu m^2$ or less, preferably 500 to 3,500 $\mu m^2$, in the sheet is 80% or more, preferably 90% or more, of the total of the clearance areas, is used. If the clearance areas of 4,000 $\mu m^2$ or less are less than 80% of the total clearance area of the sheet, the permeability of ink of the substrate, the resolving properties of printed matters and the setting-off of ink to the surface are not improved. Further, the average clearance area of the substrate sheet is preferably 500 to 2,500 $\mu m^2$ in view of the permeability of ink.

According to the present embodiment, by using a thin sheet having the above clearance area parameters as the substrate, the contact of the film onto the thermal head is improved so that the perforation of the film is carried out with precision without causing non-perforation or connected perforations; hence the resulting printed image is superior in resolution without causing setting-off of ink on the surface of printed matters.

The present invention will be described in more detail by way of concrete Examples.

EXAMPLE 1

Fibers of 100% hemp were subjected to sheet-making according to a wet sheet-making process using a conventional cylyndrical or short net type paper machine to obtain a permeable sheet of a basis weight of 8.8 g/m$^2$. The sum of the clearance areas that were equal to or less than the scanning pitch areas of the thermal head, having 400 dots per inch of heating elements of a heat-sensitive stencil-making device, occupied 84.6% of the total of the clearance areas of the sheet. After sheet making, a PET (polyethylene terephthalate) film having a thickness of 2 $\mu$m was laminated upon the above sheet with an adhesive (ultraviolet curing-type, produced by TOAGOSEI K.K.) and a releasing agent was applied onto the surface of the laminated film to obtain a heat-sensitive stencil master sheet of the present invention.

EXAMPLE 2

Example 1 was repeated except that the sheet obtained in Example 1 was replaced by a permeable sheet of a basis weight of 10.0 g/m$^2$, prepared by subjecting fibers of 60% hemp and 40% synthetic fibers (mixture of polyester fibers, polyvinylalcohol fibers and natural fibers) to a wet paper-making process, in which sheet the sum of the clearance areas that were equal to or less than the scanning pitch areas of the thermal head occupied 81.7% of the total of the clearance areas, to prepare a heat-sensitive stencil master sheet.

COMPARATIVE EXAMPLE 1

Example 1 was repeated except that the sheet of Example 1 was replaced by a permeable sheet of a basis weight of 9.6 g/m$^2$, obtained by subjecting fibers of 100% hemp to a wet paper-making process, in which sheet the sum of the clearance areas that were equal to or less than the scanning pitch areas of the thermal head occupied 72.0% of the total of the clearance areas, to prepare a heat-sensitive stencil master sheet.

COMPARATIVE EXAMPLE 2

Example 1 was repeated except that the sheet of Example 1 was replaced by a permeable sheet of a basis weight of 12.5 g/m$^2$, obtained by subjecting fibers of 100% PET to sheet-making according to a wet paper-making process, in which sheet the sum of the clearance areas that were equal to than the scanning pitch areas of the thermal head occupied 70.7% of the total of the clearance areas of the sheet, to prepare a heat-sensitive stencil master sheet.

COMPARATIVE EXAMPLE 3

Example 1 was repeated except that the sheet of Example 1 was replaced by a permeable sheet of a basis weight of 10.0 g/m$^2$ obtained by subjecting fibers of 100% hemp to sheet-making according to a wet paper-making process, in which sheet the sum of the clearance areas that were equal to or less than the scanning pitch areas of the thermal head occupied 55.0% of the total of the clearance areas of the sheet, to prepare a heat-sensitive stencil master sheet.

The heat-sensitive stencil master sheets obtained in the above Examples and Comparative examples were subjected to stencil-making by means of a heat-sensitive stencil-making device such as that produced by Riso Kagaku Corporation (RISOGRAPH RL 115D, Trademark of Riso Kagaku Corporation) having a thermal head of 400 dpi (dots per inch). The resulting perforated stencil master sheet was then subjected to printing by means of the same device.

Figure 3:
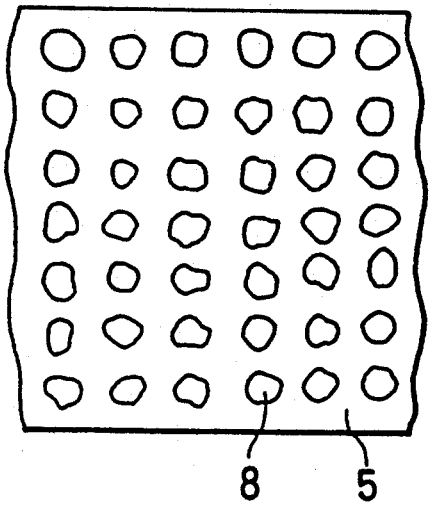
FIG. 3 shows a plan view of a film perforated by a thermal head constructed according to the teachings of the present invention.
Figure 4:
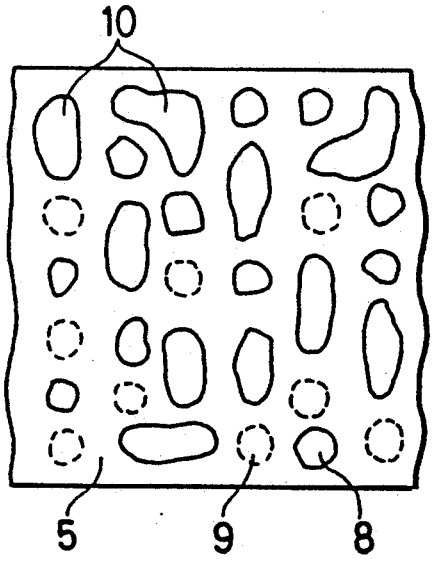
FIG.4 PRIOR ART
FIG. 4 shows a plan view of a film perforated by a thermal head constructed according to the teachings of the prior art.

The perforations of the film on the sheet were examined by means of an optical microscope. In Examples 1 and 2, since a thin sheet having the proportion of clearance areas of 4,000 $\mu m^2$ or less was 80% or more, was used as a substrate, the perforations 8 of the sheet were almost totally independent and uniform as shown in FIG. 3. On the other hand, in the case of Comparative examples 1 to 3, since the above proportion of clearance areas was less than 80%, connected perforations 10 and unsuccessful perforations 9 were generated as shown in FIG. 4.

Further, the resulting perforation and printed image were evaluated according to the following evaluation standards. The results are shown in Table 1.

Evaluation standards:

Unsuccessful perforations (visible evaluation by means of microscope)

○ - - - none, Δ - - - a few, *X* - - - many.

Connected perforations (visible evaluation by means of microscope)

○ - - - none, Δ - - - a few, *X* - - - many.

Concentration

The reflection concentration of the solid part was measured at 10 points by means of a densiometer (DM-400, Produced by Dainippon Screen Kabushiki Kaisha) and the resulting values (relative values) were averaged.

Uniformity

The uniformity of the concentration inside the solid part was evaluated according to a printed image-processing system.

○ - - - good, Δ - - - somewhat inferior, *X* - - - inferior.

Resolution: (Visible evaluation of a printed letter)

○ - - - good, Δ - - - the continuity of the letter is somewhat inferior or the letters are thick to a certain extent, *X* - - - the continuity of the letter is inferior or the letters are thick.

Preventing ink from setting-off to the surface of printed matters: (Visible evaluation)

TABLE 1

| | Example 1 | Example 2 | Comp. ex. 1 | Comp. ex. 2 | Comp. ex. 3 |
|---|---|---|---|---|---|
| Kind of fiber | Hemp | Hemp Synthetic fiber | Hemp | PET | Hemp |
| Basis weight (g/m) | 8.8 | 10.0 | 9.6 | 12.5 | 10.0 |
| Proportion of clearance areas of the sheet same as or less than scanning pitch areas (%) | 84.6 | 81.7 | 72.0 | 70.7 | 55.0 |
| Unsuccessful perforation | ○ | ○ | Δ | Δ | X |
| Connected perforation | ○ | ○ | Δ | Δ | X |
| Concentration | 0.99 | 1.02 | 1.04 | 1.05 | 1.00 |
| Uniformity | ○ | ○ | Δ | Δ | X |
| Resolution | ○ | ○ | Δ | Δ | X |
| Setting-off of ink on the surface | ○ | ○ | Δ | Δ | X |

matters: (Visible evaluation)

○- good, Δ- somewhat inferior, X- inferior.

As seen from Table 1, according to Examples 1 and 2 wherein a sheet, in which the proportion of the clearance areas of the sheet that were the same as or less than the scanning pitch areas of the thermal head was 80% or more of the total of the clearance areas, was used as the substrate, the perforations were almost totally independent, and the printing concentration became adequate due to the controlled quantity of ink passed. Thus, a good printed matter having superior resolving properties and uniformity, and particularly, few instances of setting-off of ink to the surface thereof was obtained. According to Comparative examples 1, 2 and 3, however, wherein the proportion of the clearance areas of the sheet that were the same as or less than the scanning pitch area was less than 80% of the total of the clearance areas, connected perforations and unsuccessful perforations were observed, the resolution was lowered and the setting-off of ink to the surface increased, and in an extreme case, concentration reduction was observed.

According to the present invention, by using a stencil master sheet having specific clearance areas of the sheet suitable for a thermal head of the stencil-making device, the printed image was perforated with good fidelity and with a fine and independent perforation of the film. Hence, it is possible to obtain a printed image having a superior resolution and extremely few instances of setting-off of ink to the surface of printed matters.

What we claim is:

1. A process for preparing a heat-sensitive stencil master sheet for digital perforation thereof by the thermal head of a heat-sensitive stencil making device, comprising the steps of:

providing a sheet having a plurality of fibers defining the sheet;

determining a threshold area as the product of a primary scanning pitch of the thermal head as measured at a right angle to an advancing direction of the sheet, and a secondary scanning pitch of the thermal head as measured in the advancing direction of the sheet; and adhering a thermoplastic resin film to the sheet at contacting zones of said thermoplastic resin film, said contacting zones being defined as areas of the thermoplastic resin film that are supportedly contacted by said fibers, said contacting zones defining clearance zones of said thermoplastic resin film as being areas of the thermoplastic resin film that are not supportedly contacted by said fibers, wherein at least 80% of the plurality of clearance zones respectively have areas of less than or equal to the threshold area.

2. A process for preparing a heat-sensitive stencil master sheet as claimed in claim 1, wherein the thermal head provides at least 400 dots per inch.

3. A process for preparing a heat-sensitive stencil master sheet as claimed in claim 2, wherein the threshold area is 4000 $\mu m^2$.

4. A process for preparing a heat-sensitive stencil master sheet as claimed in claim 1, wherein the threshold area is 4000 $\mu m^2$.

5. A process for preparing a heat-sensitive stencil master sheet as claimed in claim 1, wherein the average area of all clearance zones is between 500 $\mu m^2$ and 2500 $\mu m^2$.

6. A process for preparing a heat-sensitive master sheet as claimed in claim 1, wherein the basis weight of said sheet is between 6 $g/m^2$ and 14 $g/m^2$, and the fineness of said fibers is less than or equal to 3 denier.

7. A process for preparing a heat-sensitive stencil master sheet for digital perforation thereof by the thermal head of a heat-sensitive stencil making device, comprising the steps of:

determining a threshold area;

determining an acceptable value for a percentage of clearance zones having areas of less than or equal to the threshold area;

providing a sheet including a plurality of fibers defining the sheet, said fibers defining a sheet area that includes a first zone comprising the area occupied by said plurality of fibers, and a second zone comprising the area occupied by a plurality of clearance zones respectively defined as spaces bounded by adjacent fibers, so that the plurality of clearance zones include at least the acceptable percentage of clearance zones having areas less than or equal to the threshold area, said percentage being defined as the number of clearance zones having areas less than or equal to the threshold area divided by the total number of clearance zones.

8. A process for preparing a heat-sensitive stencil master sheet as claimed in claim 7, further comprising the step of determining the threshold area as the product of a primary scanning pitch of the thermal head as measured at a right angle to an advancing direction of the sheet, and a secondary scanning pitch of the thermal head as measured in the advancing direction of the sheet.

9. A process for preparing a heat-sensitive stencil master sheet as claimed in claim 8, wherein the acceptable percentage is 80%.

10. A process for preparing a heat-sensitive stencil master sheet as claimed in claim 7, wherein the acceptable percentage is 80%.

11. A process for preparing a heat-sensitive stencil master sheet as claimed in claim 7, wherein the thermal head provides at least 400 dots per inch.

12. A process for preparing a heat-sensitive stencil master sheet as claimed in claim 11, wherein the threshold area is 4000 $\mu m^2$.

13. A process for preparing a heat-sensitive stencil master sheet as claimed in claim 7, wherein the threshold area is 4000 $\mu m^2$.

14. A process for preparing a heat-sensitive stencil master sheet as claimed in claim 7, wherein the average area of all clearance zones is between 500 $\mu m^2$ and 2500 $\mu m^2$.

15. A process for preparing a heat-sensitive stencil master sheet as claimed in claim 7, wherein the basis weight of said sheet is between 6 $g/m^2$ and 14 $g/m^2$, and the fineness of said fibers is less than or equal to 3 denier.

* * * * *